US011430317B2

(12) United States Patent
Ko et al.

(10) Patent No.: US 11,430,317 B2
(45) Date of Patent: Aug. 30, 2022

(54) COMMUNICATION SYSTEM FOR UNDERWATER LIFESAVING AND METHOD FOR IDENTIFYING PERSON IN WATER

(71) Applicant: Hoseo University Academic Cooperation Foundation, Asan-Si (KR)

(72) Inventors: Hak Lim Ko, Asan-si (KR); Yong Ho Cho, Yuseong-Gu (KR); Tae Ho Im, Cheonan-Si (KR)

(73) Assignee: HOSEO UNIVERSITY ACADEMIC COOPERATION FOUNDATION, Asan-Si (KR)

( * ) Notice: Subject to any disclaimer, the term of this patent is extended or adjusted under 35 U.S.C. 154(b) by 46 days.

(21) Appl. No.: 17/142,020

(22) Filed: Jan. 5, 2021

(65) Prior Publication Data

US 2021/0264763 A1 Aug. 26, 2021

(30) Foreign Application Priority Data

Feb. 25, 2020 (KR) ..... 10-2020-0023113

(51) Int. Cl.
*G08B 21/08* (2006.01)

(52) U.S. Cl.
CPC ..... *G08B 21/088* (2013.01)

(58) Field of Classification Search
CPC .. G08B 21/088; G08B 21/0202; G08B 25/01; G08B 25/14; G06Q 50/26; H02J 9/005
See application file for complete search history.

(56) References Cited

U.S. PATENT DOCUMENTS 6,154,140 A * 11/2000 Thorpe ..... B63C 11/02 340/626
9,251,686 B1 * 2/2016 Reich ..... G08B 21/088
2003/0194084 A1 * 10/2003 Gilmour ..... H04B 1/385 379/433.1
2007/0200716 A1 * 8/2007 Haase ..... G08B 21/0202 340/574
2008/0266118 A1 * 10/2008 Pierson ..... A61B 5/0205 340/573.6
2010/0076331 A1 * 3/2010 Chan ..... A61B 5/681 600/509

(Continued)

FOREIGN PATENT DOCUMENTS

KR 10-2015-0114286 10/2015
KR 10-2016-0072445 6/2016

(Continued)

*Primary Examiner* — Curtis J King
(74) *Attorney, Agent, or Firm* — Stradley Ronon Stevens & Young, LLP

(57) ABSTRACT

A communication system for underwater lifesaving and a method for locating a person immersed in water. The communication system for underwater lifesaving includes: a water immersion signal generation unit that is worn on the body of a user, detects whether the user is immersed in water, and generates a water immersion detection signal corresponding to the user when water immersion is detected; and a water immersion signal reception unit that receives a water immersion detection signal generated by the water immersion signal generation unit and analyzes the location of the user in response to a water immersion detection signal being received.

20 Claims, 5 Drawing Sheets

(56) References Cited

U.S. PATENT DOCUMENTS

| | | | | |
|---|---|---|---|---|
| 2014/0278229 | A1* | 9/2014 | Hong | A61B 5/02433 702/160 |
| 2016/0119705 | A1* | 4/2016 | Ramirez | H04R 1/1008 381/384 |
| 2017/0086321 | A1* | 3/2017 | de Jong | F16K 24/00 |
| 2018/0028106 | A1* | 2/2018 | Leschinsky | A61B 5/1032 |
| 2018/0040223 | A1* | 2/2018 | Bodi | G08B 21/0415 |
| 2018/0286217 | A1* | 10/2018 | Guido | G08B 25/10 |
| 2019/0098383 | A1* | 3/2019 | Ely | H01R 13/22 |
| 2020/0126391 | A1* | 4/2020 | Lovett | G08B 25/10 |
| 2022/0036717 | A1* | 2/2022 | Lovett | G08B 21/0277 |

FOREIGN PATENT DOCUMENTS

| | | |
|---|---|---|
| KR | 10-2017-0081023 | 7/2017 |
| KR | 10-1781018 | 9/2017 |
| KR | 10-2019-0044790 | 5/2019 |
| KR | 10-1981732 | 5/2019 |

* cited by examiner

FIG. 1
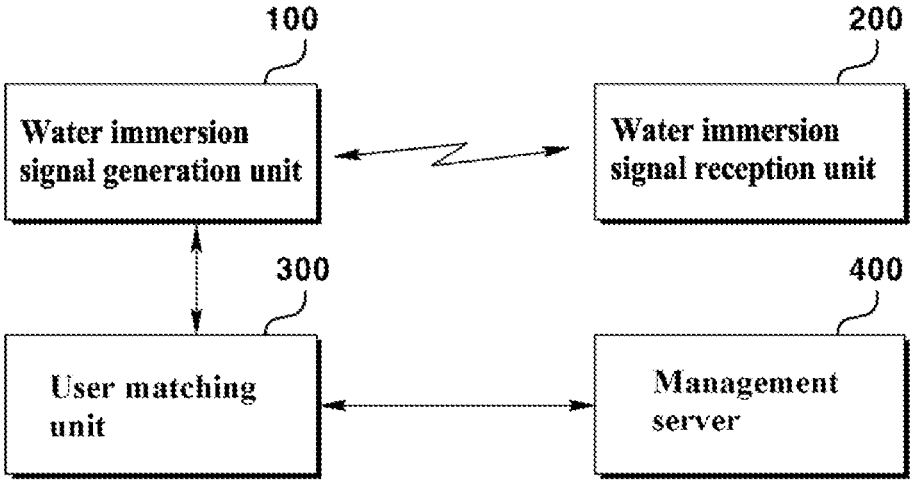
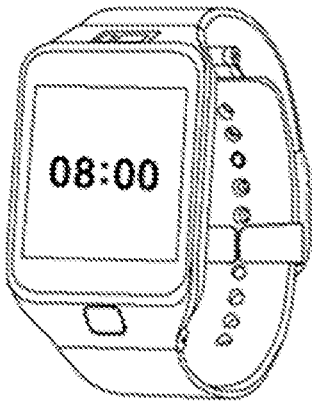
FIG. 2A
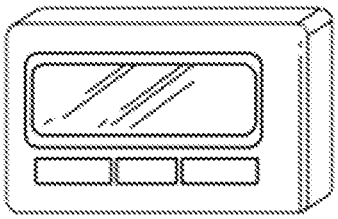
FIG. 2B

FIG. 3
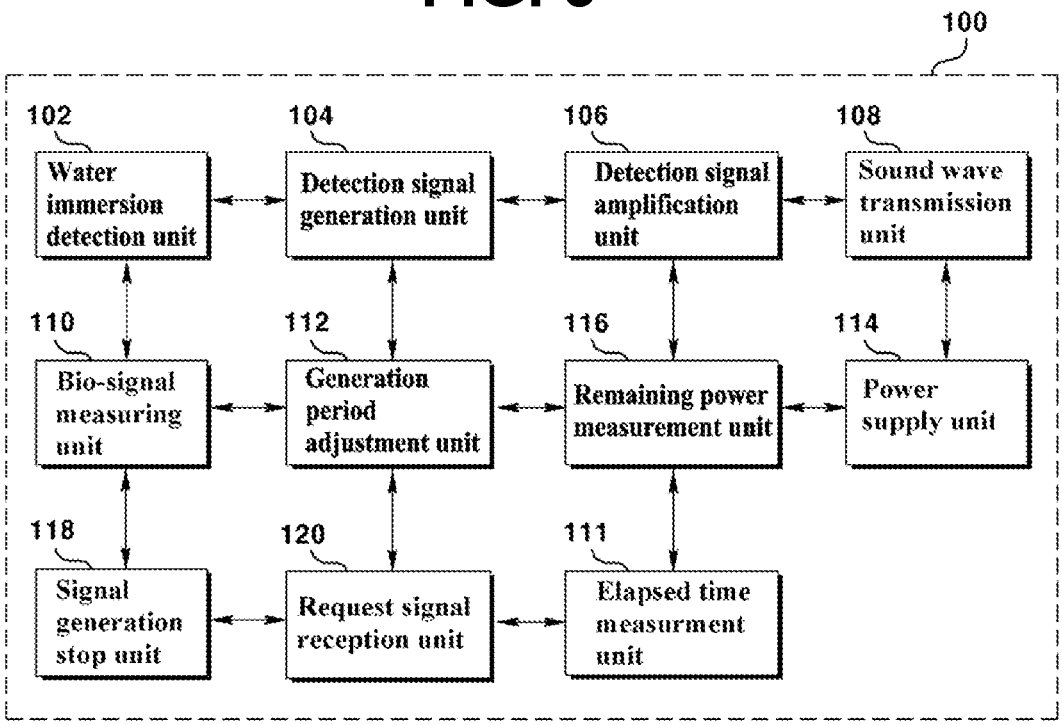
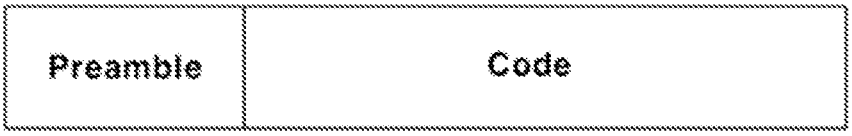
FIG. 4A
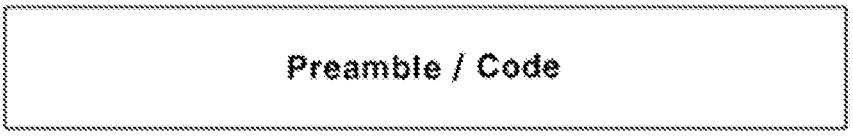
FIG. 4B

FIG. 5
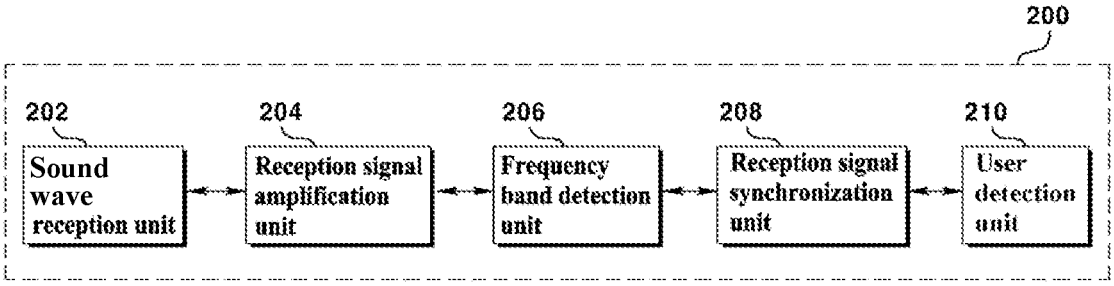
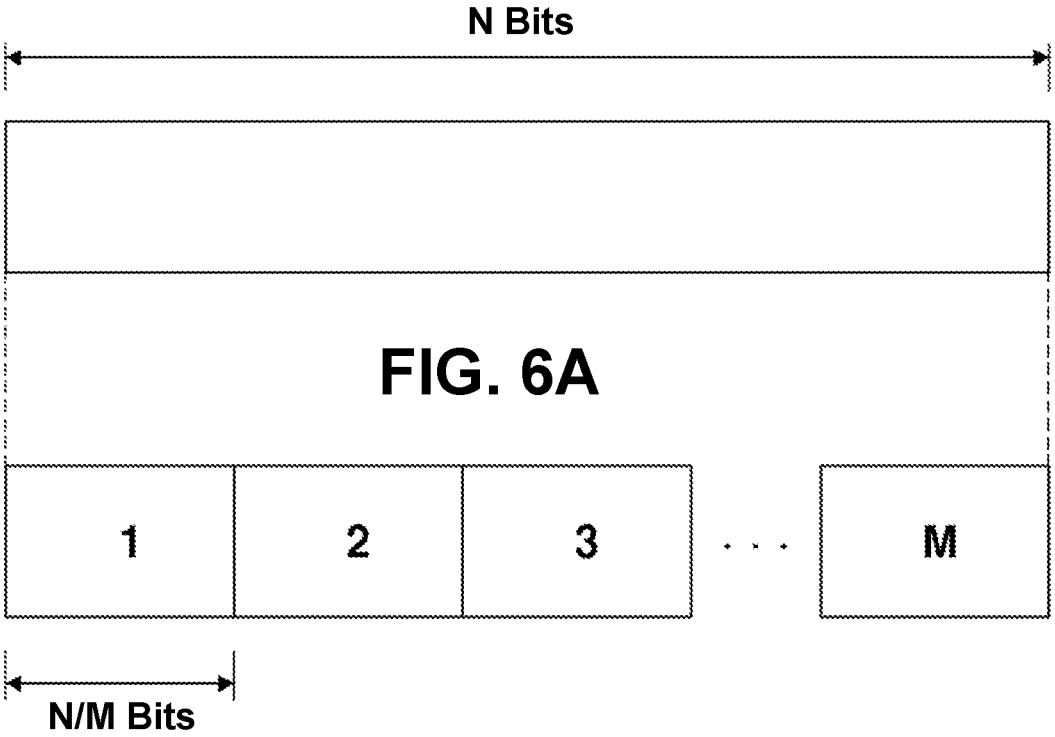
FIG. 6A
FIG. 6B

COMMUNICATION SYSTEM FOR UNDERWATER LIFESAVING AND METHOD FOR IDENTIFYING PERSON IN WATER

RELATED APPLICATION

This application claims the benefit of priority to Korean Patent Application Number 10-2020-0023113 titled COMMUNICATION SYSTEM FOR UNDERWATER LIFESAVING AND METHOD FOR IDENTIFYING PERSON IN WATER filed on Feb. 25, 2020, the contents of which are incorporated in this application by reference.

TECHNICAL FIELD

The present invention relates to a communication system for underwater lifesaving and a method for identifying a person in water, and more particularly, relates to a communication system for underwater lifesaving and a method for promptly identifying the location of a drowning person in water, thereby supporting a quick lifesaving effort when an accident occurs in a sea, river, lake, or other body of water and a person is drowning.

BACKGROUND OF THE DISCLOSURE

In seas, rivers, lakes, and other bodies of water, unexpected accidents such as people being swept away by sudden winds, people are drowning due to an overturn or collision of a ship, or people are drowning when a sudden increase in water level occurs unexpectedly.

In the case of such an accident, even if the person involved in the accident is able to swim or is wearing a life jacket, the body temperature of the person involved in the accident in the water drops sharply, so a quick lifesaving must be achieved.

In seas, rivers, lakes, and other bodies of water, however, because the flow velocity and current are generally not constant, the location of the person involved in the accident at the time of the accident and the location of the person at the later time of attempting lifesaving are different. Therefore, even if a search for the person involved in the accident is made while expanding the surroundings from the point of the accident, it may not be possible to find the person early, and crucial time is often lost.

It becomes especially difficult to estimate the location of the person involved in the accident, which varies as time progresses, when the flow rate or current of the sea, river, lake, or other body of water is rapid or the wind strength, temperature, and other environmental factors are unstable after the accident. Consequently, a problem arises in that it takes considerable time and labor to search for the person involved in the accident.

One attempt to address the problems described above is disclosed in Korean Patent Publication No. 10-2016-0072445 published on Jun. 23, 2016 and titled "Drone for Saving a Life on the Sea." The publication discloses an unmanned air vehicle for saving a life on the sea. The vehicle can float on the sea using a tube after landing on the sea and can rescue a person having an accident by approaching the person. More specifically, disclosed is a vehicle having a flight body, multiple support units extended from the outer circumference of the flight body and installed at fixed intervals based on the center of the flight body, a driving motor fixed to an outer end of each of the support units, a propeller connected to the driving motor and rotated by the driving motor as a center shaft formed to be vertical to the flight body, and a tube installed in the lower part of the flight body and expanded by gas.

SUMMARY OF THE INVENTION

An object of the present invention devised to solve the above-described problems is to provide a communication system for underwater lifesaving and a method for identifying a person immersed in water for promptly identifying the location of a drowning person in water, thereby supporting a quick lifesaving effort when an accident occurs in a sea, river, lake, or other body of water and a person is drowning.

The communication system for underwater lifesaving according to an aspect of the present invention for achieving the above object includes: a water immersion signal generation unit, which is worn on the body of a user, for detecting a water immersion of a user, and generating a water immersion detection signal corresponding to the user when a water immersion is detected; and a water immersion signal reception unit for receiving a water immersion detection signal generated by the water immersion signal generation unit, and analyzing the location of the user in response to the water immersion detection signal being received.

The above-described communication system for underwater lifesaving may further include: a management server for registering and storing the water immersion signal generation unit; and a user matching unit for matching the user with the water immersion signal generation unit.

The water immersion signal generation unit may include: a water immersion detection unit for detecting a water immersion of a user; a detection signal generation unit for generating a water immersion detection signal corresponding to the user when a water immersion of the user is detected; a detection signal amplification unit for amplifying the water immersion detection signal being generated; and a sound wave transmission unit for converting the water immersion detection signal being amplified into sound waves and transmitting them.

In addition, the water immersion signal generation unit may further include: a bio-signal measuring unit for measuring a bio-signal including at least one of a pulse rate, a body temperature, and a movement of a user; an elapsed time measurement unit for measuring an elapsed time of a water immersion from the time point when a water immersion of a user is detected; and a generation period adjustment unit for adjusting a generation period of the water immersion detection signal according to at least one of the bio-signal being measured and the elapsed time of the water immersion.

In addition, the water immersion signal generation unit may comprise: a power supply unit for supplying power; and a remaining power measurement unit for measuring a remaining amount of power supplied by the power supply unit. In this case, the generation period adjustment unit adjusts the generation period of the water immersion detection signal according to the remaining amount of the power supply unit being measured.

In addition, the water immersion signal generation unit may further include: a signal generation stop unit configured to stop the generation of the water immersion detection signal when the bio-signal being measured is less than or equal to a predetermined value and/or the remaining amount of power in the power supply unit is less than or equal to a predetermined value or the elapsed time of the measured water immersion is greater than or equal to a predetermined value; and a request signal reception unit for receiving a request signal for generating a signal from the water immersion signal reception unit. In this case, the detection signal generation unit generates the water immersion detection signal when a request signal is received through the request signal reception unit.

At this time, the sound wave transmission unit transmits a signal for obtaining synchronization and a signal including user information about the user.

In addition, the sound wave transmission unit may transmit frequencies allocated to different bands corresponding to the group to which the user belongs, and preamble signals differently allocated to correspond to the user.

In addition, the water immersion signal reception unit may include: a block dividing unit for dividing the total number of bits of the water immersion detection signal received from the water immersion signal generation unit into a predetermined number of blocks; and a filtering unit for performing a matched filtering on each of the blocks divided by the block dividing unit.

A method for identifying a person in water according to an aspect of the present invention for achieving the above object, the method for identifying a person immersed in water carried out by a communication system for underwater lifesaving, includes the steps of: detecting a water immersion of a user by a water immersion signal generation unit worn on the body of the user; generating a water immersion detection signal when a water immersion of a user is detected; amplifying the water immersion detection signal being generated; transmitting the amplified water immersion detection signal after converting the water immersion detection signal being amplified into sound waves; receiving a signal transmitted by the water immersion signal generation unit by a water immersion signal reception unit; and analyzing the location of the user in response to a signal being received from the water immersion signal generation unit.

The above-described method for identifying a person immersed in water may further include a step of registration after matching the user with the water immersion signal generation unit by a management server.

The above-described method for identifying a person immersed in water may further include the steps of: measuring an elapsed time of water immersion from a time point when a water immersion of a user is detected by the water immersion signal generation unit, and measuring a bio-signal including at least one of a pulse rate, a body temperature, and a movement of the user; and adjusting a generation period of the water immersion detection signal according to at least one of the elapsed time of water immersion being measured and the bio-signal.

In addition, the above-described method for identifying a person immersed in water may further include the steps of: measuring the remaining amount of power being supplied, by the water immersion signal generation unit; and adjusting the generation period of the water immersion detection signal according to the remaining amount of power being measured.

In addition, the above-described method for identifying a person immersed in water may further include the steps of: stopping the generation of the water immersion detection signal by the water immersion signal generation unit, when the bio-signal being measured is less than or equal to a predetermined value and/or the remaining amount of the power is less than or equal to a predetermined value or the elapsed time of water immersion being measured is greater than or equal to a predetermined value; receiving a request signal for signal generation from the water immersion signal reception unit; and generating the water immersion detection signal in response to the request signal being received.

In addition, the above-described method for identifying a person immersed in water may further include the steps of: dividing by the water immersion signal reception unit the total number of bits of the signal being received from the water immersion signal generation unit into a predetermined number of blocks; and performing matched filtering on each of the divided blocks.

According to the present invention, when an accident occurs in a sea, river, lake, or other body of water and a person is drowning, the disclosed invention supports a quick lifesaving effort by promptly identifying the location of a drowning person in the water.

BRIEF DESCRIPTION OF THE DRAWING

The disclosure is best understood from the following detailed description when read in connection with the accompanying drawing. Included in the drawing are the following figures:

FIG. 1 is a diagram schematically illustrating a communication system for underwater lifesaving according to an embodiment of the present invention;

FIGS. 2A and 2B illustrate embodiments of the water immersion signal generation unit shown in FIG. 1;

FIG. 3 is a diagram schematically illustrating a configuration of the water immersion signal generation unit shown in FIG. 1;

FIGS. 4A and 4B illustrate embodiments of a frame structure of a signal transmitted by a water immersion signal generation unit;

FIG. 5 is a diagram schematically illustrating the configuration of the water immersion signal reception unit shown in FIG. 1;

FIGS. 6A and 6B illustrate embodiments of a frame structure divided by a water immersion signal reception unit;

DETAILED DESCRIPTION OF THE DISCLOSURE

Figure 7:
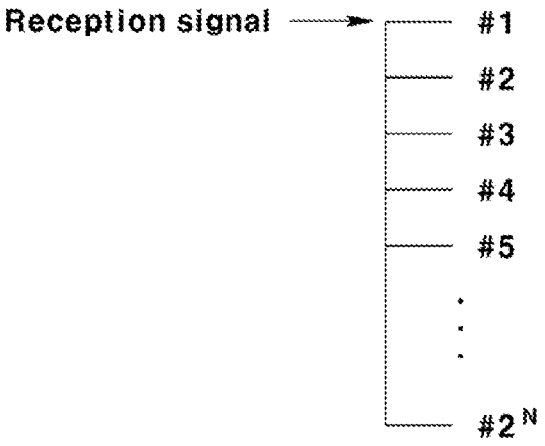
FIG. 7 is a diagram illustrating a matched filtering method using a signal of FIG. 6A.

Some embodiments of the present invention are described below with reference to the exemplary figures. In the description of reference numerals for components of each figure, the same components are denoted by the same numerals as possible even if they are indicated on different figures. In addition, in describing an embodiment of the present invention, if it is determined that a detailed description of a related known configuration or function interferes with an understanding of an embodiment of the present invention, a detailed description thereof will be omitted.

In addition, in describing the constituent elements of an embodiment of the present invention, terms such as first, second, A, B, (a), and, (b) may be used. These terms are only used to distinguish the component from other components, and the nature or order of the component is not limited by the term. When a first component is described as being "connected," "coupled," or "interconnected" to another component, the first component may be directly connected, coupled, or interconnected to the other component or a third component may be connected, coupled, or interconnected between the first component and the other component.

FIG. 1 is a diagram schematically illustrating a communication system for underwater lifesaving according to an embodiment of the present invention.

Referring to FIG. 1, a communication system for underwater lifesaving according to the present invention comprises a water immersion signal generation unit 100, a water immersion signal reception unit 200, a user matching unit 300, and a management server 400.

The water immersion signal generation unit 100 is worn on the body of a user, detects a water immersion of a user, and generates a water immersion detection signal corresponding to the user when the water immersion of the user is detected.

The water immersion signal generation unit 100 may be implemented in the form of a wristwatch worn on the wrist of a user as illustrated in FIG. 2A, or implemented in the form of a device worn on the waistband of a user as illustrated in FIG. 2B. The water immersion signal generation unit 100 may have any shape, however, as long as it can be worn on the body of a user, and is not limited to the illustrated shapes.

The water immersion signal generation unit 100 may comprise a sensing film (not shown) that detects whether water is in contact with the outer surface thereof. In addition, the water immersion signal generation unit 100 comprises a pressure sensor (not shown) that measures the pressure or water pressure applied to the outer surface in order to accurately discriminate whether it is simply wet or if the user is immersed in water. Through this feature, the water immersion signal generation unit 100 can determine that a user is in water when an area greater than or equal to a predetermined value among the total area of the outer surface is wetted with water, and the pressure or water pressure applied to the outer surface is greater than or equal to a predetermined value. By "predetermined" is meant determined beforehand, so that the predetermined characteristic must be determined, i.e., chosen or at least known, in advance of some event. The method of the water immersion signal generation unit 100 to determine whether a user is immersed in water or not is not limited to the described method, however, and may determine whether a user is immersed in water or not by using various known methods.

In addition, the water immersion signal generation unit 100 generates a water immersion detection signal corresponding to a user when a water immersion of the user is detected. The water immersion signal generation unit 100 is allocated with a unique identification information, and when a water immersion of a user is detected, the unique identification information may be included in the water immersion detection signal. In this case, the water immersion signal generation unit 100 wirelessly transmits the water immersion detection signal including the unique identification information.

The water immersion signal reception unit 200 receives a water immersion detection signal generated by the water immersion signal generation unit 100 and analyzes the location of the user in response to the water immersion detection signal being received. The water immersion signal reception unit 200 may be installed on a ship; in a lake, a river, or other body of water; on a shore, etc., and receives the water immersion detection signal transmitted wirelessly from the water immersion signal generation unit 100, and by analyzing the water immersion detection signal, the conditions such as the present location of the user and a present pulse rate, body temperature, or other physical characteristic of the user can be determined. In addition, when a plurality of water immersion signal reception units 200 receive a water immersion detection signal, the location of the user can be determined by analyzing the water immersion detection signal being received by each of the water immersion signal reception units 200 by using a known technique such as a triangulation.

The user matching unit 300 may perform short-range wireless communication such as near field communication (NFC) and Bluetooth with the water immersion signal generation unit 100. The user matching unit 300 registers a user boarding a ship or registers a user approaching a lake, river, beach, etc., and that user can be matched with a user corresponding to the water immersion signal generation unit 100 provided to and worn by each user.

The management server 400 registers and stores information about the water immersion signal generation unit 100 provided to a user in ships, lakes, rivers, beaches, and the like. The management server 400 communicates with the user matching unit 300 through wire or wirelessly, and when a user and the water immersion signal generation unit 100 are matched by the user matching unit 100, each user corresponding to the water immersion signal generation unit 100 can be stored together. In addition, the management server 400 may store a group classified for a plurality of users and a frequency band allocated to each group.

FIG. 3 is a diagram schematically illustrating a configuration of the water immersion signal generation unit shown in FIG. 1.

Referring to FIG. 3, the water immersion signal generation unit 100 includes: a water immersion detection unit 102; a detection signal generation unit 104; a detection signal amplification unit 106; a sound wave transmission unit 108; a bio-signal measurement unit 110; an elapsed time measurement unit 111; a generation period adjustment unit 112; a power supply unit 114; a remaining power measurement unit 116; a signal generation stop unit 118; and a request signal receiving unit 120.

The water immersion detection unit 102 detects a water immersion of a user. To this end, the water immersion detection unit 102 has a detection film that detects whether water is in contact with the external surface, a pressure sensor that detects the pressure of water applied to the external surface, a water pressure sensor, and the like, as described above.

The detection signal generation unit 104 generates a water immersion detection signal corresponding to a user when water immersion of the user is detected by the water immersion detection unit 102. The detection signal generation unit 104 stores unique identification information and, when a water immersion of a user is detected, the water immersion detection signal including the corresponding unique identification information may be generated.

The detection signal amplification unit 106 amplifies a water immersion detection signal generated by the detection signal generation unit 104. The detection signal amplification unit 106 performs post-processing including noise filtering on the water immersion detection signal generated by the detection signal generation unit 104. It is desirable to amplify only the filtered and post-processed water immersion detection signal.

The sound wave transmission unit 108 converts the water immersion detection signal amplified by the detection signal amplification unit 106 into sound waves and transmits the sound waves. The reason why the sound wave transmission unit 108 converts the water immersion detection signal into sound waves and transmits them is that electromagnetic waves are rapidly attenuated under the water, so many limitations apply to using them as a way to communicate, but sound waves can propagate relatively far underwater compared to electromagnetic waves. The sound wave transmission unit 108 may transmit a signal for acquiring synchronization and a signal including user information about a user as sound waves. In this case, the signal transmitted by the sound wave transmission unit 108 may have a frame structure including a preamble and a code, as illustrated in FIG. 4A. As shown in FIG. 4A, the preamble allows the water immersion signal reception unit 200 to acquire frame synchronization for the water immersion detection signal, and the code enables the water immersion signal reception unit 200 to obtain user information such as identification information for the user and status information for the user from the water immersion detection signal. The signal transmitted by the sound wave transmission unit 108 is not limited to such a frame structure, however, and may be formed in a frame structure in which a synchronization acquisition preamble and user information are integrated as illustrated in FIG. 4B.

Meanwhile, the sound wave transmission unit 108 may transmit frequencies allocated to different bands corresponding to a group to which the user belongs, with preamble signals differently allocated to correspond to the user. That is, when the number of users boarding a ship or the number of users playing in the water at a river, lake, beach, etc. is greater than a predetermined value, each user can be classified into a plurality of groups each having a predetermined number or less. Assuming that the frequency band usable underwater is 10 kHz to 20 kHz, and the bandwidth of the water immersion detection signal that can be detected by the water immersion detection unit 102 is 2 kHz, the communication system for underwater lifesaving according to an embodiment of the present invention can be divided into five groups of 10~12 kHz, 12~14 kHz, 14~16 kHz, 16~18 kHz, and 18~20 kHz, and the groups of users can be classified into five groups, and thereby different frequency bands can be assigned to each classified group. In this case, the sound wave transmission unit 108 transmits a sound wave signal at a frequency of a band allocated to and corresponding with the group to which the user belongs.

In this way, the communication system for underwater lifesaving according to an embodiment of the present invention classifies the groups of users into a plurality of groups, and the sound wave transmission unit 108 transmits sound waves in different frequency bands according to the group to which the user belongs so that, in the case where multiple users are in water, it is possible to prevent the sound waves corresponding to each user from causing mutual interference.

In addition, the communication system for underwater lifesaving according to an embodiment of the present invention may allocate different preambles in response to the users. The communication system for underwater lifesaving can distinguish users in each group by allocating different preambles among users belonging to the same group.

The bio-signal measurement unit 110 measures a bio-signal including at least one of the pulse rate, body temperature, and movement of a user. The bio-signal measurement unit 110 may be in close contact with the body of the user to measure the pulse rate per unit time or body temperature. In addition, the bio-signal measurement unit 110 may measure the movement of the user using an acceleration sensor. The bio-signal measurement unit 110 measures bio-signals of the user according to a predetermined period. In this case, it is preferable that the bio-signal measurement unit 110 measures the bio-signal according to the generation period of the water immersion detection signal described below.

The elapsed time measurement unit 111 measures the elapsed water immersion time from the point when a water immersion of a user is detected. That is, when a water immersion of a user is detected by the water immersion detection unit 102, the elapsed time measurement unit 111 counts the time from the time point when the water immersion is detected.

The generation period adjustment unit 112 adjusts the generation period of the water immersion detection signal according to at least one of the bio-signal measured by the bio-signal measurement unit 110 and the elapsed water immersion time. For example, the generation period adjustment unit 112 may control the detection signal generation unit 104 so that a water immersion detection signal is generated according to a predetermined first generation period at an initial time when a user is immersed in water, and thereafter it controls the detection signal generation unit 104 so as to generate a water immersion detection signal according to the second generation period set to a value faster than the first generation period in response to the case when the pulse rate per unit time measured by the bio-signal measurement unit 110 falls below the predetermined value or the rate of motion per unit time falls below the predetermined value. In addition, the generation period adjustment unit 112 may control the detection signal generation unit 104 so that the water immersion detection signal is generated according to the third generation period set to a value between the first generation period and the second generation period, in the case when the elapsed time of water immersion is determined to permit resuscitation through emergency rescue such as cardiopulmonary resuscitation, heart shock, and the like through statistical medical experience, even if the pulse rate per unit time or the ratio of movement per unit time measured by the bio-signal measurement unit 110 is zero. In this way, the communication system for underwater lifesaving according to an embodiment of the present invention can request a rapid rescue of a user by adjusting the generation period of the water immersion detection signal when it is determined that the current state of the user is urgent based on the bio-signal of the user or the elapsed time of water immersion.

The power supply unit 114 supplies power to each component of the water immersion signal generation unit 100. The power supply unit 114 may be implemented as a primary battery in which charging and discharging are not repeated, or a secondary battery in which charging and discharging are repeated.

The remaining power measurement unit 116 measures a remaining amount of power to be supplied by the power supply unit 114. That is, the remaining power measurement unit 116 measures the remaining amount of electric energy that can be supplied by the power supply unit 114 in real time. The remaining power measurement unit 116 may measure the remaining amount of power that can be supplied to the user according to a predetermined period. It is preferable that the remaining power measurement unit 116 measures the remaining amount of power according to the generation period of the water immersion detection signal adjusted by the generation period adjustment unit 112. The generation period adjustment unit 112 may control the detection signal generation unit 104 so that the generation period of the water immersion detection signal is adjusted and generated according to a value measured by the remaining power measurement unit 116. For example, when the remaining amount of power is measured as 70% or more, the generation period adjustment unit 112 may control the detection signal generation unit 104 to generate a water immersion detection signal according to a predetermined first generation period. In addition, as the remaining amount of measured power falls from 70 to 50%, from 50 to 30%, etc., the generation period adjustment unit 112 may control the detection signal generation unit 104 so that the generation period of the water immersion detection signal is slowed down to a second generation period set to a value slower than the first generation period, a third generation period set to a value slower than the second generation cycle, and so on. In this way, in the communication system for underwater lifesaving according to an embodiment of the present invention, the water immersion detection signal can be transmitted for a long time by adjusting the generation period of the water immersion detection signal in consideration of the remaining amount of power.

Meanwhile, the generation period adjustment unit 112 may adjust the generation period of the water immersion detection signal in consideration of a bio-signal of a user, the remaining amount of power, and the elapsed water immersion time. In this case, when it is determined that the user is currently alive through the bio-signal, it is preferred that the generation period adjustment unit 112 controls the generation cycle of the water immersion detection signal by prioritizing the bio-signal of the user.

The signal generation stop unit 118 controls the detection signal generation unit 104 so that the generation of a water immersion detection signal is stopped in the case when the bio-signal measured by the bio-signal measurement unit 110 is less than or equal to a predetermined value and/or the remaining power measured by the remaining power measurement unit 116 is less than or equal to a predetermined value, and the elapsed water immersion time is greater than or equal to the predetermined value. For example, if there is no pulse or movement of the user over a predetermined time interval, and the remaining power is 50% or less, and the elapsed water immersion time indicates that it would be impossible to revive the user after the predetermined time has elapsed, the signal generation stop unit 118 may control the detection signal generation unit 104 to stop the generation of the water immersion detection signal.

The request signal reception unit 120 receives a signal generation request signal from the water immersion signal reception unit 200. That is, when the generation of the water immersion detection signal is stopped by the signal generation stop unit 118, the request signal reception unit 120 may receive a request signal requesting the generation of a water immersion detection signal from the water immersion signal reception unit 200. In this case, the detection signal generation unit 104 generates a water immersion detection signal for the water immersion of the user in response to the request signal received by the request signal reception unit 120.

FIG. 5 is a diagram schematically illustrating the configuration of the water immersion signal reception unit 200 shown in FIG. 1.

Referring to FIG. 5, the water immersion signal reception unit 200 includes a sound wave reception unit 202, a reception signal amplification unit 204, a frequency band detection unit 206, a reception signal synchronization unit 208, and a user detection unit 210.

The sound wave reception unit 202 receives a water immersion detection signal generated by the water immersion signal generation unit 100, and the reception signal amplifying unit 204 amplifies the sound wave received by the sound wave reception unit 202.

The frequency band detection unit 206 determines the corresponding frequency band for the frequency of the sound wave received by the sound wave reception unit 202. The frequency band detection unit 206 stores a group classified for a plurality of users and a frequency band allocated as corresponding to each group, and determines the frequency band to which the corresponding sound wave belongs and the group to which the sound wave of the user belongs by determining the frequency of the received sound wave.

The reception signal synchronization unit 208 synchronizes the received signal using a preamble allocated to the sound wave signal. The reception signal synchronization unit 208 is allocated with different preambles corresponding to each user in the same group, so that the user in the water can be identified for each preamble.

The user detection unit 210 detects a user corresponding to the sound wave signal and the location of the water immersion based on the frequency band of the sound wave signal detected by the frequency band detection unit 206 and the user identified by the reception signal synchronization unit 208. The user detection unit 210 interlocks with the water immersion signal reception unit 200 installed at different locations, and the location of the user can be detected by analyzing sound wave signals received by each water immersion signal reception unit 200 using a known technology such as triangulation and the like.

The water immersion signal reception unit 200 may divide the total number of bits of the water immersion detection signal received from the water immersion signal generation unit 100 into a predetermined number of blocks. That is, when the total number of bits of the water immersion detection signal received from the water immersion signal generation unit 100 is N bits as illustrated in FIG. 6A, the water immersion signal reception unit 200 is as illustrated in FIG. 6B, and the number of N bits can be divided into M blocks. The number of bits of each block becomes N/M bits. For example, assuming that the total number of bits of the water immersion detection signal received from the water immersion signal generation unit 100 is 20 bits, the sound wave reception unit 202 can divide the 20-bit water immersion detection signal into five blocks. In this case, the number of bits of each block becomes 4 bits.

Figure 8:
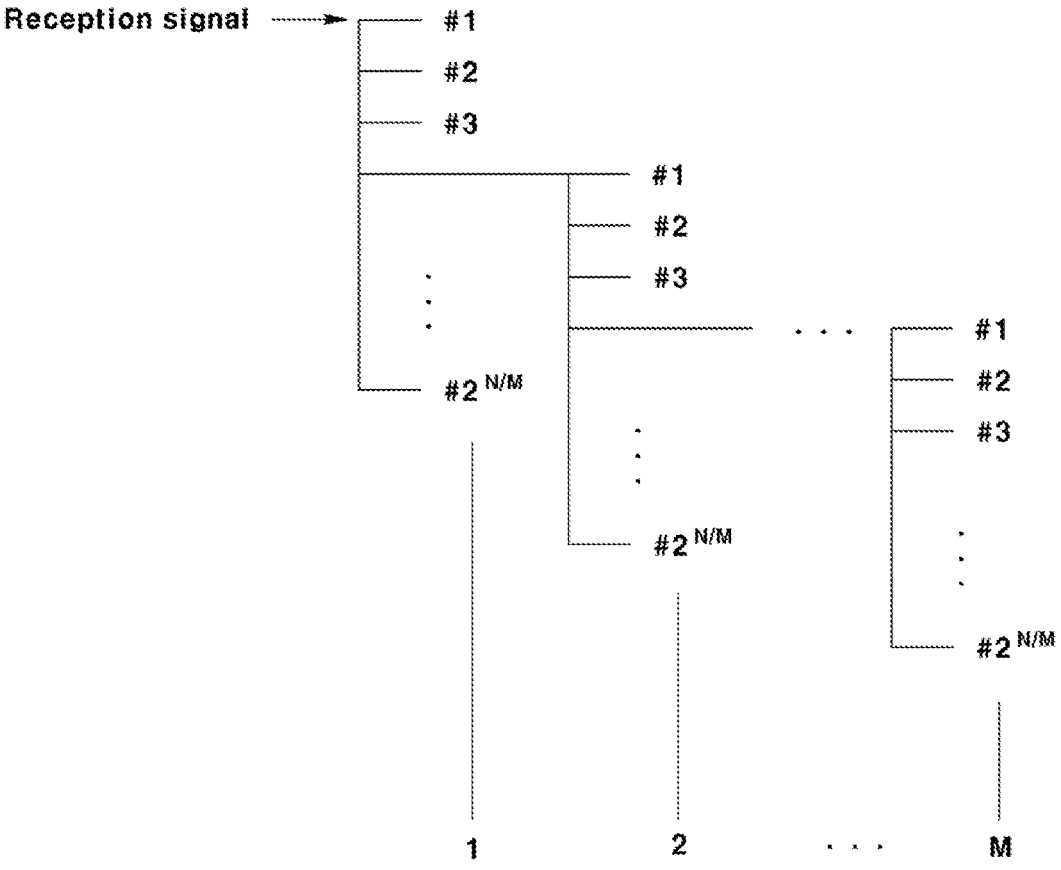
FIG. 8 is a diagram illustrating a matched filtering method using a signal of FIG. 6B.

In addition, the water immersion signal reception unit 200 may amplify each divided block at a predetermined magnification. In addition, the water immersion signal reception unit 200 performs matched filtering on each block divided by the sound wave reception unit 202. When matched filtering is performed as it is on the water immersion detection signal having the number of N bits, the number of cases of the matched filter becomes $2^N$ as illustrated in FIG. 7. For example, when the total number of bits of the water immersion detection signal is 20 bits, the number of cases of the matching filter becomes $2^{20}=1{,}048{,}576\approx10^6$. When the water immersion detection signal is divided into M blocks and matched filtering is performed for each block, however, the number of cases of the matched filter performed for each block is $2^{N/M}$ as illustrated in FIG. 8. In addition, the total number of cases of the matched filter for the water immersion detection signal becomes $2^{N/M}\times M$. For example, when the total number of bits of the water immersion detection signal is divided into 5 blocks as in the case of the above example, the number of cases of the matched filter performed for each block is $2^4=16$, and the total number of cases of the matched filter for the detection signal is $16\times5=80$. Accordingly, the communication system for underwater lifesaving according to an embodiment of the present invention can significantly reduce the matched filtering time and the amount of computation for user identification at the receiving end.

Figure 9:
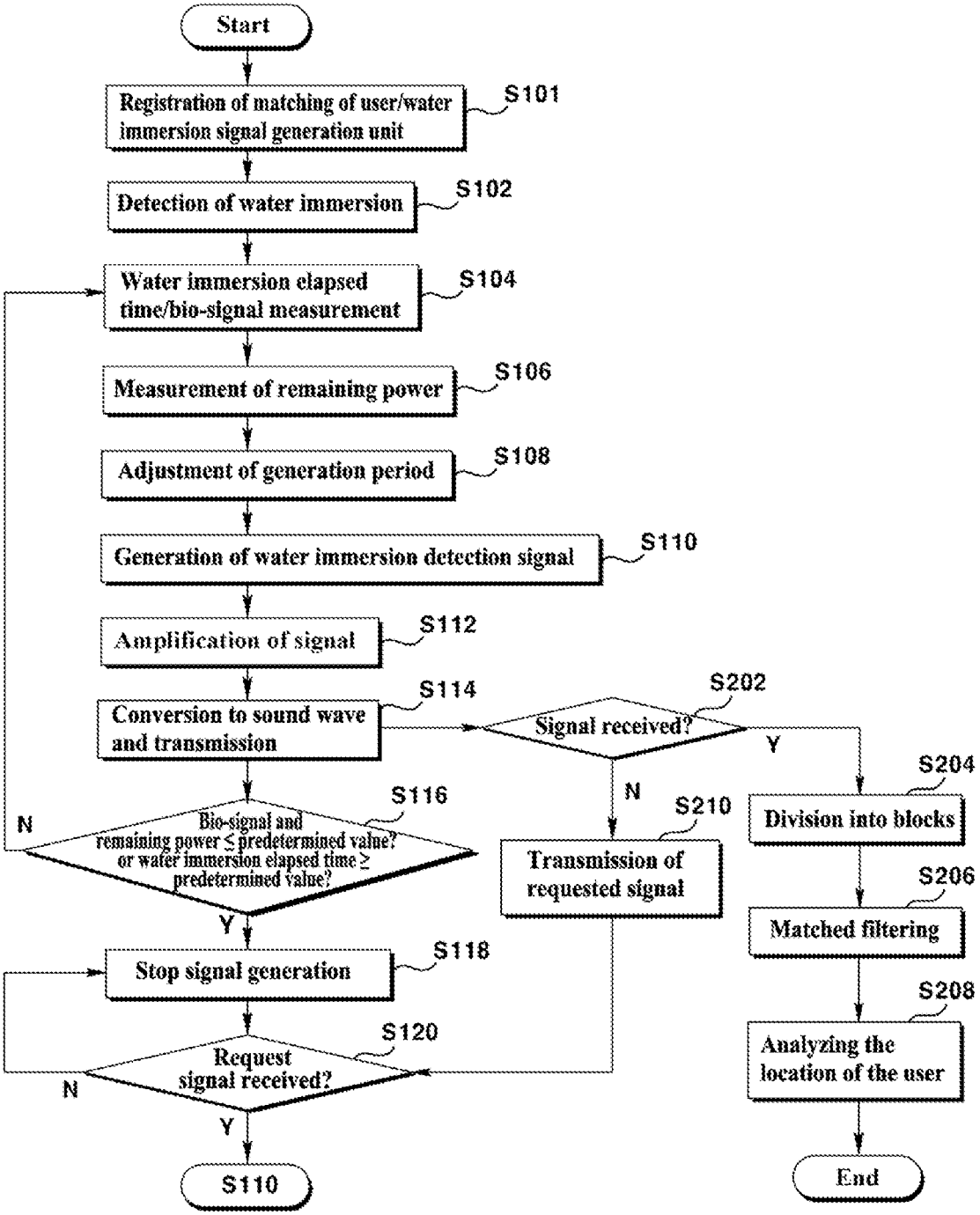
FIG. 9 is a flowchart showing a method for identifying a person in water according to an embodiment of the present invention.

FIG. 9 is a flowchart showing a method for identifying a person in water according to an embodiment of the present invention. The method for identifying a person in water according to an embodiment of the present invention may be performed by the communication system for underwater lifesaving shown in FIG. 1. The method step S101 is performed by the user matching unit 300 and the management server 400, the method steps S102 to S120 are performed by the water immersion signal generation unit 100, and the method steps S202 to S210 are performed by the water immersion signal reception unit 200.

Referring to FIG. 1 and to FIG. 9, the management server 400 may register and store identification information for a plurality of water immersion signal generation units 100. When the water immersion signal generation unit 100 is provided to and worn by a user located on a ship or by a user who plays in the water at a river, lake, shore, and the like, the user matching unit 300 matches the pre-stored user information with the water immersion signal generation unit 100 through short-range wireless communication. The user information matched by the user matching unit 300 and the identification information of the water immersion signal generation unit 100 are transmitted to the management server 400 and managed thereby (method step S101).

The water immersion signal generation unit 100 detects water immersion of a user (method step S102). To this end, the water immersion signal generation unit 100 may include a detection film that detects whether water is in contact with the outer surface thereof, and a pressure sensor, a water pressure sensor, or the like that detects the pressure of water applied to the surface from the outside.

When a user in water is detected, the water immersion signal generation unit 100 measures a bio-signal including at least one of the pulse rate, body temperature, and movement of the user (method step S104). That is, the water immersion signal generation unit 100 may be in close contact with the body of the user to measure a pulse rate per unit time or a body temperature. In addition, the water immersion signal generation unit 100 may measure a movement of the user using an acceleration sensor. In addition, when a water immersion of a user is detected, the water immersion signal generation unit 100 measures the elapsed water immersion time from the time point when a water immersion of a user is detected.

The water immersion signal generation unit 100 also measures the remaining amount of supplied power (method step S106). That is, the water immersion signal generation unit 100 measures, in real time, the remaining amount of electric energy that can be supplied.

The water immersion signal generation unit 100 may adjust the generation period of the water immersion detection signal according to at least one of the measured bio-signal, the remaining amount of power, and the elapsed water immersion time (method step S108). For example, the water immersion signal generation unit 100 generates a water immersion detection signal according to a predetermined first generation cycle at the initial time when a user is immersed in water and, thereafter, generates a water immersion detection signal according to the second generation period which is preset to a value faster than the first generation period when the measured pulse rate per unit time falls below the set value or the rate of movement per unit time falls below the predetermined value. In addition, the water immersion signal generation unit 100 may generate the water immersion detection signal according to the third generation period set to a value between the first generation period and the second generation period, in the case when the elapsed time of water immersion is determined to render possible resuscitation through emergency rescue such as cardiopulmonary resuscitation, heart shock, and the like through statistical medical experience, even if the pulse rate per unit time or the ratio of movement per unit time being measured is zero. In this way, the communication system for underwater lifesaving according to an embodiment of the present invention can request a rapid rescue of a user by adjusting the generation period of the water immersion detection signal when it is determined that the current state of the user is urgent based on the bio-signal of the user.

The water immersion signal generation unit 100 adjusts the generation period of the water immersion detection signal according to the remaining amount of power to be measured. For example, when the remaining amount of the measured power is 70% or more, the water immersion signal generation unit 100 generates a water immersion detection signal according to a preset first generation period. In addition, the water immersion signal generation unit 100 also adjusts the generation period of the water immersion detection signal to be slowed down to a second generation period set to a value slower than the first generation period, a third generation period set to a value slower than the second generation period, etc. as the remaining amount of power to be measured falls from 70 to about 50%, then 50 to about 30%. In this way, in the communication system for underwater lifesaving according to an embodiment of the present invention, the water immersion detection signal can be transmitted for a long time by adjusting the generation period of the water immersion detection signal in consideration of the remaining amount of power.

Meanwhile, the water immersion signal generation unit 100 adjusts the generation period of the water immersion detection signal in consideration of the bio-signal of the user, the remaining amount of power, and the elapsed water immersion time, taken together. In this case, when the water immersion signal generation unit 100 determines that the user is currently alive through the bio-signal, it is preferable to control the generation period of the water immersion detection signal by giving priority to the bio-signal of the user.

The water immersion signal generation unit 100 generates a water immersion detection signal according to the adjusted generation period (method step S110). The water immersion signal generation unit 100 is stored with unique identification information, and when a water immersion of a user is detected, a water immersion detection signal including the corresponding unique identification information can be generated.

The water immersion signal generation unit 100 amplifies the generated water immersion detection signal (method step S112). It is preferable that the water immersion signal generation unit 100 filters noise from the generated water immersion detection signal and amplifies only the filtered water immersion detection signal.

The water immersion signal generation unit 100 converts the amplified water immersion detection signal into sound waves and transmits the sound waves (method step S114). The reason why the water immersion signal generation unit 100 converts the water immersion detection signal into sound waves and transmits them is that electromagnetic waves are rapidly attenuated under the water, so many limitations apply to using them as a way to communicate, but sound waves can propagate relatively far underwater compared to electromagnetic waves.

Meanwhile, when the measured bio-signal and the remaining power are less than or equal to the pre-set or predetermined value or the elapsed water immersion time is greater than or equal to the pre-set or predetermined value (method step S116), the water immersion signal generation unit 100 stops generating the water immersion detection signal (method step S118). For example, when there is no pulse or movement of a user over a predetermined time interval, and the remaining amount of power is 50% or less, the water immersion signal generation unit 100 may stop generating the water immersion detection signal.

The water immersion signal generation unit 100 receives a request signal for signal generation from the water immersion signal reception unit 200 when generation of the water immersion detection signal is stopped. That is, the water immersion signal reception unit 200 transmits a request signal requesting the generation of a water immersion detection signal, and the water immersion signal generation unit 100 may receive a request signal requesting the generation of a water immersion detection signal transmitted by the water immersion signal reception unit 200 (method step S120). In this case, the water immersion signal generation unit 100 generates a water immersion detection signal for the water immersion of the user according to method step S110 in response to the received request signal. Or, the water immersion signal generation unit 100 measures a bio-signal of a user at a time point when the request signal is received, and may generate a water immersion detection signal including the measured bio-signal.

When the water immersion signal reception unit 200 receives the water immersion detection signal from the water immersion signal generation unit 100 (method step S202), it divides the total number of bits of the received water immersion detection signal into a predetermined number of blocks (method step S204). That is, when the total number of bits of the water immersion detection signal received from the water immersion signal generation unit 100 is N bits, the water immersion signal reception unit 200 may divide the number of N bits into M blocks. The number of bits of each block is N/M bits. For example, assuming that the total number of bits of the water immersion detection signal received from the water immersion signal generation unit 100 is 20 bits, the water immersion signal reception unit 200 may divide the water immersion detection signal of 20 bits into 5 blocks. In this case, the number of bits in each block is 4 bits.

The water immersion signal reception unit 200 performs matched filtering on each of the divided blocks (method step S206). In this case, when matched filtering is performed as it is for a water immersion detection signal having N number of bits, the number of cases of the matched filters becomes $2^N$. For example, when the total number of bits of the water immersion detection signal is 20 bits, the number of cases of the matched filters is $2^{20}=1{,}048{,}576\approx10^6$. If the water immersion detection signal is divided into M blocks and matched filtering is performed for each block, however, the number of cases of the matched filters performed for each block is $2^{N/M}$, and the total number of cases of the matched filters for the water immersion detection signal becomes $2^{N/M}\times M$. As in the case of the above example, when the total number of bits of the water immersion detection signal is divided into five blocks, the number of cases of the matched filters performed for each block is $2^4=16$, and the total number of cases of the matched filters for the water immersion detection signal becomes $16\times5=80$. Thereby the communication system for underwater lifesaving according to an embodiment of the present invention can significantly reduce the matched filtering time and the amount of computation for user identification at the receiving end.

The water immersion signal reception unit 200 analyzes the location of the user based on the matched filtered water immersion detection signal (method step S208). In this case, the water immersion signal reception unit 200 analyzes the location of a user based on the water immersion detection signal received by the plurality of water immersion signal reception units 200.

Meanwhile, when the water immersion signal reception unit 200 has not received a water immersion detection signal for a predetermined time from the water immersion signal generation unit 100 within a predetermined range, generation of a water immersion detection signal is requested of the water immersion signal generation unit 100 (method step S210). In this case, the request signal transmitted by the water immersion signal reception unit 200 is transmitted to the periphery within a predetermined radius and, accordingly, it is possible to receive a water immersion detection signal from the water immersion signal generation unit 100 which has been prompted by a corresponding request signal.

Although the embodiments according to the present invention have been described above, these are only exemplary, and a person skilled in the art will understand that various modifications and equivalent ranges of embodiments are possible therefrom. Therefore, the scope of protection of the present invention should be determined not only by the following claims, but also by those equivalents thereto.

What is claimed:

1. A communication system for underwater lifesaving comprising:

a water immersion signal generation unit, which is adapted to be worn on a body of a user, for detecting a water immersion of the user and generating a water immersion detection signal corresponding to the user when the water immersion is detected; and a water immersion signal reception unit for receiving the water immersion detection signal generated by the water immersion signal generation unit and analyzing a location of the user in response to the water immersion detection signal being received, wherein the water immersion signal generation unit includes:

a water immersion detection unit for detecting the water immersion of the user, a detection signal generation unit for generating the water immersion detection signal corresponding to the user when the water immersion of the user is detected, a detection signal amplification unit for amplifying the water immersion detection signal being generated, a sound wave transmission unit for converting the water immersion detection signal being amplified into at least one sound wave and transmitting the sound wave, a bio-signal measuring unit for measuring a bio-signal including at least one of a pulse rate, a body temperature, and a movement of the user, an elapsed time measurement unit for measuring an elapsed time of water immersion from a time point when the water immersion of the user is detected, and a generation period adjustment unit for adjusting a generation period of the water immersion detection signal according to at least one of the bio-signal being measured and the elapsed time of the water immersion, wherein the generation period adjustment unit controls the water immersion signal generation unit so that a first water immersion detection signal is generated according to a first generation period at the time point when the water immersion of the user is detected, and a second water immersion detection signal is generated according to a second generation period set to a value faster than the first generation period if the pulse rate per unit time or the rate of movement per unit time falls below a predetermined value, and a third water immersion detection signal is generated according to a third generation period set to a value between the first generation period and the second generation period, even if there is no pulse rate per unit time or rate of movement per unit time, in the case when the elapsed time of water immersion is within the predetermined time.

2. The communication system for underwater lifesaving according to claim 1, further comprising:

a management server for registering and storing the water immersion signal generation unit; and a user matching unit for matching the user with the water immersion signal generation unit.

3. The communication system for underwater lifesaving according to claim 1, wherein the water immersion signal generation unit includes a power supply unit for supplying power and a remaining power measurement unit for measuring a remaining amount of power supplied by the power supply unit, and wherein the generation period adjustment unit adjusts the generation period of the water immersion detection signal according to the remaining amount of power being measured.

4. The communication system for underwater lifesaving according to claim 3, wherein the water immersion signal generation unit further includes a signal generation stop unit configured to stop the generation of the water immersion detection signal when at least one of the bio-signal being measured is less than or equal to a predetermined value or the remaining amount of power is less than or equal to a predetermined value or the elapsed time of the measured water immersion is greater than or equal to a predetermined value, and a request signal reception unit for receiving a request signal requesting the generation of a water immersion detection signal from the water immersion signal reception unit, wherein the detection signal generation unit generates the water immersion detection signal when a request signal is received from the request signal reception unit.

5. The communication system for underwater lifesaving according to claim 1, wherein the sound wave transmission unit transmits a signal for obtaining synchronization and a signal including user information about the user.

6. The communication system for underwater lifesaving according to claim 1, wherein the sound wave transmission unit transmits frequencies allocated to different bands corresponding to a group to which the user belongs, and preamble signals differently allocated to correspond to the user.

7. The communication system for underwater lifesaving according to claim 1, wherein the water immersion detection signal received from the water immersion signal generation unit has a total number of bits and the water immersion signal reception unit includes a block dividing unit for dividing the total number of bits of the water immersion detection signal received from the water immersion signal generation unit into a predetermined number of blocks, and a filtering unit for performing a matched filtering on each of the blocks divided by the block dividing unit.

8. The communication system for underwater lifesaving according to claim 1, wherein the water immersion signal generation unit is in the form of a wristwatch adapted to be worn on a wrist of the user.

9. The communication system for underwater lifesaving according to claim 1, wherein the water immersion signal generation unit is in the form of a device adapted to be worn on a waistband of the user.

10. The communication system for underwater lifesaving according to claim 1, wherein the water immersion signal reception unit includes a sound wave reception unit configured to receive the sound wave transmitted by the sound wave transmission unit.

11. The communication system for underwater lifesaving according to claim 10, wherein the water immersion signal reception unit further includes a reception signal amplification unit configured to amplify the sound wave received by the sound wave reception unit.

12. The communication system for underwater lifesaving according to claim 11, wherein the water immersion signal reception unit further includes a frequency band detection unit configured to determine a frequency band to which the sound wave received by the sound wave reception unit belongs.

13. The communication system for underwater lifesaving according to claim 12, wherein the water immersion signal reception unit further includes a reception signal synchronization unit configured to synchronize the sound wave received by the sound wave reception unit using a preamble allocated to the sound wave.

14. The communication system for underwater lifesaving according to claim 13, wherein the water immersion signal reception unit further includes a user detection unit configured to detect the user corresponding to the sound wave and the location of the water immersion based on the frequency band of the sound wave detected by the frequency band detection unit and the user identified by the reception signal synchronization unit.

15. A communication system for underwater lifesaving comprising:

a water immersion signal generation unit, which is adapted to be worn on a body of a user, for detecting a water immersion of the user and generating a water immersion detection signal corresponding to the user when the water immersion is detected, wherein the water immersion signal generation unit includes:

a water immersion detection unit for detecting the water immersion of the user, a detection signal generation unit for generating the water immersion detection signal corresponding to the user when the water immersion of the user is detected, a detection signal amplification unit for amplifying the water immersion detection signal being generated, a sound wave transmission unit for converting the water immersion detection signal being amplified into at least one sound wave and transmitting the sound wave, a bio-signal measuring unit for measuring a bio-signal including at least one of a pulse rate, a body temperature, and a movement of the user, an elapsed time measurement unit for measuring an elapsed time of water immersion from a time point when the water immersion of the user is detected, a generation period adjustment unit for adjusting a generation period of the water immersion detection signal according to at least one of the bio-signal being measured and the elapsed time of the water immersion, a power supply unit for supplying power, a remaining power measurement unit for measuring a remaining amount of power supplied by the power supply unit, and wherein the generation period adjustment unit adjusts the generation period of the water immersion detection signal according to the remaining amount of power being measured, a signal generation stop unit configured to stop the generation of the water immersion detection signal when at least one of the bio-signal being measured is less than or equal to a predetermined value or the remaining amount of power is less than or equal to a predetermined value or the elapsed time of the measured water immersion is greater than or equal to a predetermined value, and a request signal reception unit for receiving a request signal requesting the generation of a water immersion detection signal from the water immersion signal reception unit, wherein the detection signal generation unit generates the water immersion detection signal when a request signal is received from the request signal reception unit;

a water immersion signal reception unit for receiving the water immersion detection signal generated by the water immersion signal generation unit and analyzing a location of the user in response to the water immersion detection signal being received;

a management server for registering and storing the water immersion signal generation unit; and a user matching unit for matching the user with the water immersion signal generation unit, wherein the generation period adjustment unit controls the water immersion signal generation unit so that a first water immersion detection signal is generated according to a first generation period at the time point when the water immersion of the user is detected, and a second water immersion detection signal is generated according to a second generation period set to a value faster than the first generation period if the pulse rate per unit time or the rate of movement per unit time falls below a predetermined value, and a third water immersion detection signal is generated according to a third generation period set to a value between the first generation period and the second generation period, even if there is no pulse rate per unit time or rate of movement per unit time, in the case when the elapsed time of water immersion is within the predetermined time.

16. A method for identifying a user having a body immersed in water, the method for identifying the user immersed in water carried out by a communication system for underwater lifesaving, the method comprising the steps of:

detecting a water immersion of the user by a water immersion signal generation unit worn on the body of the user;

measuring an elapsed time of water immersion from a time point when the water immersion of the user is detected by the water immersion signal generation unit;

measuring a bio-signal including at least one of a pulse rate, a body temperature, and a movement of the user;

adjusting a generation period of the water immersion detection signal according to at least one of the elapsed time of water immersion and the bio-signal being measured;

generating a water immersion detection signal when a water immersion of the user is detected;

amplifying the water immersion detection signal being generated;

transmitting the amplified water immersion detection signal after converting the water immersion detection signal being amplified into at least one sound wave;

receiving a signal transmitted from the water immersion signal generation unit by a water immersion signal reception unit; and analyzing a location of the user in response to the signal being received by the water immersion signal reception unit from the water immersion signal generation unit, wherein the step of adjusting the generation period of the water immersion detection signal adjusts the generation period so that a first water immersion detection signal is generated according to a first generation period at an initial time point when the water immersion of the user is detected, and a second water immersion detection signal is generated according to a second generation period set to a value faster than the first generation period if the pulse rate per unit time or the rate of movement per unit time falls below a predetermined value, and a third water immersion detection signal is generated according to a third generation period set to a value between the first generation period and the second generation period, even if there is no pulse rate per unit time or rate of movement per unit time, in the case when the elapsed time of water immersion is within the predetermined time.

17. The method for identifying a user immersed in water according to claim 16, further comprising a step of registering after matching the user with the water immersion signal generation unit by a management server.

18. The method for identifying a user immersed in water according to claim 16, further comprising the steps of:

measuring the remaining amount of power being supplied by the water immersion signal generation unit; and adjusting the generation period of the water immersion detection signal according to the remaining amount of power being measured.

19. The method for identifying a user immersed in water according to claim 16, further comprising the steps of:

measuring the remaining amount of power being supplied by the water immersion signal generation unit;

stopping the generation of the water immersion detection signal by the water immersion signal generation unit when at least one of the bio-signal being measured is less than or equal to a predetermined value or the remaining amount of power is less than or equal to a predetermined value or the elapsed time of water immersion being measured is greater than or equal to a predetermined value;

receiving a request signal for signal generation from the water immersion signal reception unit; and generating the water immersion detection signal in response to the request signal being received.

20. The method for identifying a user immersed in water according to claim 16, further comprising the steps of:

dividing the total number of bits of the signal being received from the water immersion signal generation unit into a predetermined number of blocks by the water immersion signal reception unit; and performing matched filtering on each of the divided blocks.

* * * * *